United States Patent [19]

Gaines et al.

[11] Patent Number: 4,751,623

[45] Date of Patent: Jun. 14, 1988

[54] HEAT DEACTIVATED ILLUMINATION DEVICE

[75] Inventors: Donald R. Gaines, Farmington Hills; William T. Piett, Milford, both of Mich.

[73] Assignee: Novo Products, Inc., Plymouth, Mich.

[21] Appl. No.: 923,305

[22] Filed: Oct. 27, 1986

[51] Int. Cl.[4] ..... F21V 25/10

[52] U.S. Cl. ..... 362/276; 362/802; 337/113; 315/74

[58] Field of Search ..... 315/150, 112, 74; 337/113, 91; 362/802, 253, 276

[56] References Cited

U.S. PATENT DOCUMENTS

| | | | |
|---|---|---|---|
| 1,683,992 | 9/1928 | Shoenberg et al. . | |
| 1,733,743 | 10/1929 | Ludwig . | |
| 2,458,724 | 1/1949 | Parissi et al. | 337/113 |
| 2,678,979 | 5/1954 | Beese . | |
| 3,457,383 | 7/1969 | Roberts, Jr. et al. . | |
| 3,968,355 | 7/1976 | Smallegan . | |
| 4,131,868 | 12/1978 | Dombrowski et al. | 337/113 |
| 4,136,381 | 1/1979 | Bone . | |
| 4,343,032 | 8/1982 | Schwartz | 362/802 |
| 4,396,898 | 8/1983 | Tibolla | 337/113 |

*Primary Examiner*—Carroll B. Dority, Jr.
*Attorney, Agent, or Firm*—Harness, Dickey & Pierce

[57] ABSTRACT

An illumination device according to the present invention generally includes a housing, electrical plug prongs, a connector portion associated with the housing for receiving and electrically contacting a light bulb, and a heat sensitive electrical circuit for conducting electrical current from an electrical outlet or other electrical power source to a light bulb received within through the connector portion of the illumination device. Preferably, the heat sensitive electrical circuit includes a bimetallic strip or other heat sensitive mechanism that automatically interrupts the flow of electrical current through the connector portion of the night light when the temperature sensed by the bimetallic strip exceeds a predetermined temperature level. In another embodiment of the present invention, an illumination device is equipped with a successive heat sensitive switching mechanism, in which the power conducted to the light bulb is initially reduced in response to ambient temperature levels exceeding a first predetermined temperature level, with the flow of electrical current to the light bulb being interrupted only in response to a second, higher predetermined temperature level.

31 Claims, 3 Drawing Sheets

FIG. 1.
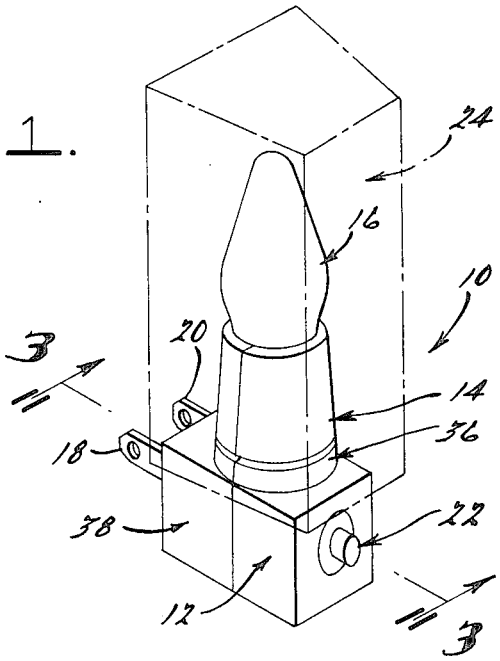
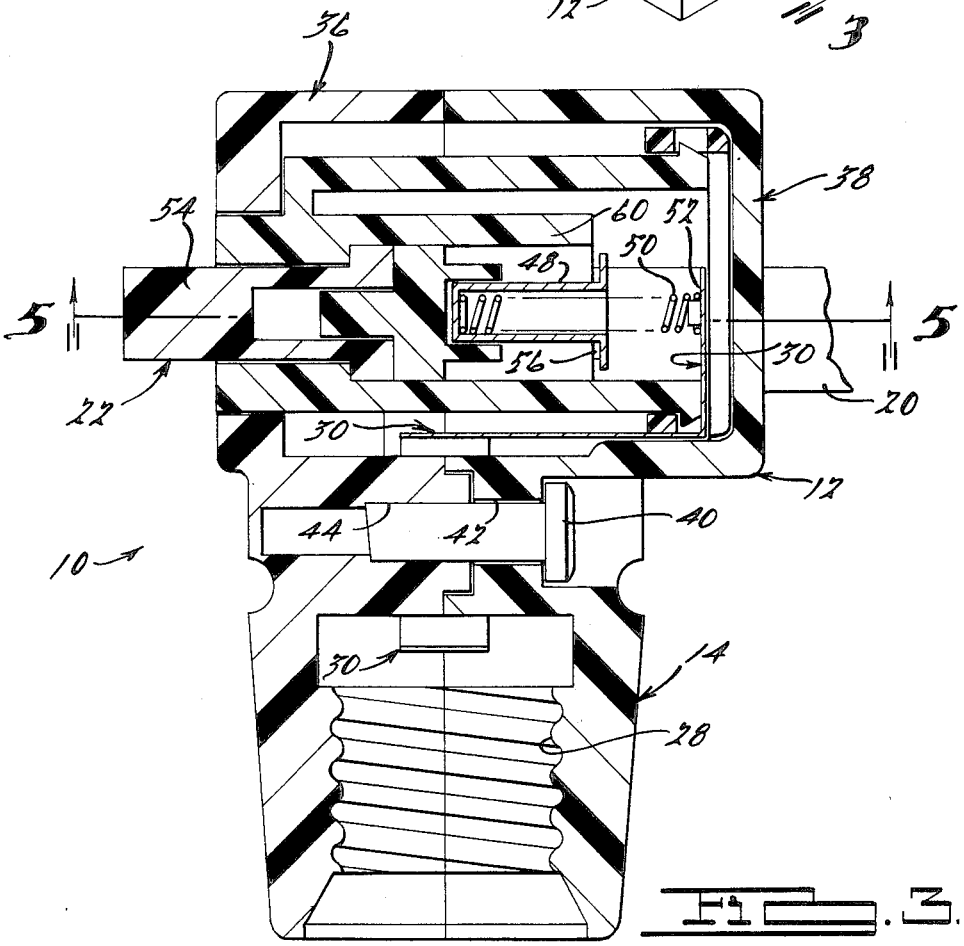
FIG. 3.

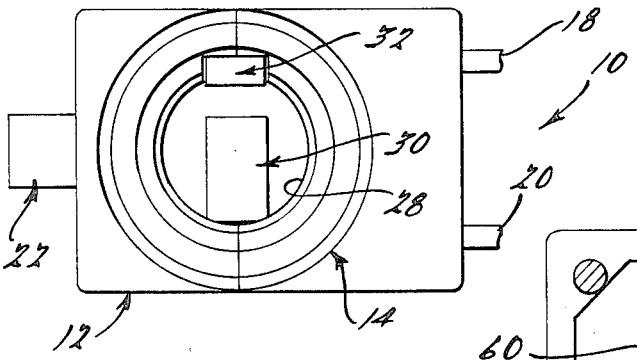
FIG. 2.
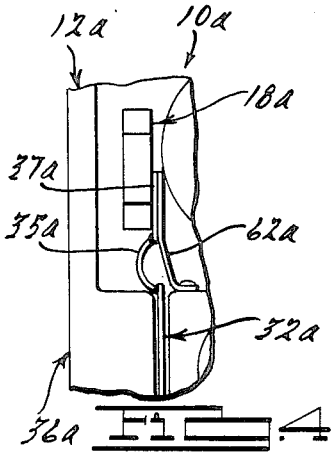
FIG. 4A.
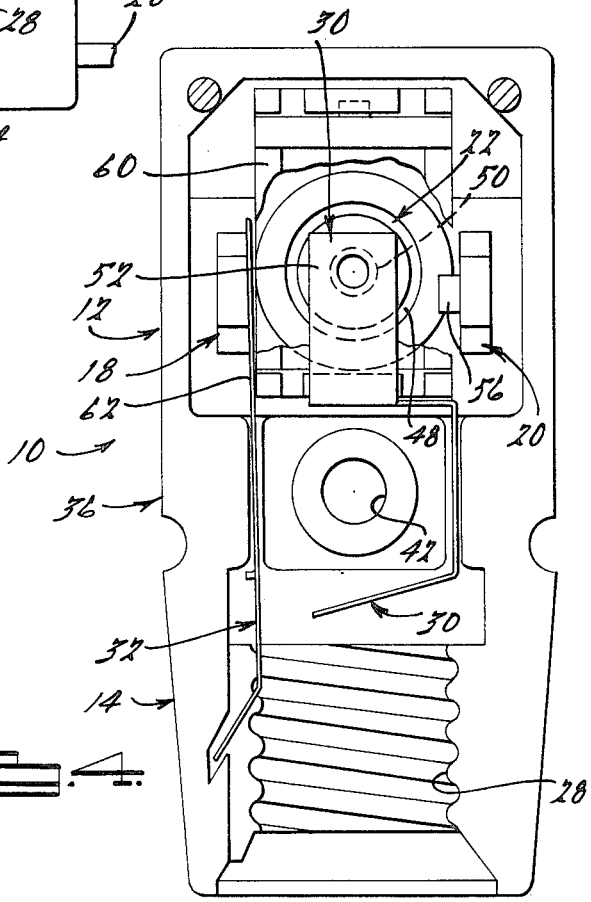
FIG. 4.
FIG. 5.
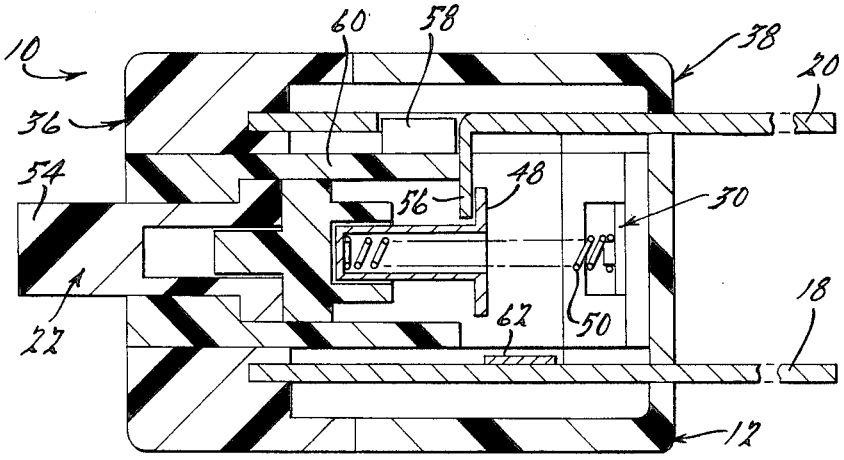

HEAT DEACTIVATED ILLUMINATION DEVICE

BACKGROUND AND SUMMARY OF THE INVENTION

The present invention relates generally to illumination devices, such as night lights for example. More particularly, the present invention relates to illumination devices including apparatuses for automatically deactivating or deenergizing the lights when the immediate ambient temperature exceeds a predetermined temperature level.

A wide variety of night lights and other illumination devices are well-known in the prior art. In one common type of night light contruction, the light bulb is energized only when the night light is plugged into an electrical outlet receptacle and thus remains illuminated until the night light is removed from the receptacle. In another very common night light construction, a manually-actuable switch is provided so that the light bulb can be selectively energized or deenergized while the night light is still electrically connected to an electrical outlet receptacle. Frequently, in still another common type of night light, the manual switch is replaced by a light sensitive switch that automatically energizes the light bulb in response to a predetermined low ambient light condition and deenergizes the light bulb in response to a predetermined high ambient light level. An example of such an automatic, light sensitive night light device is disclosed and described in U.S. Pat. No. 3,968,355, issued July 6, 1976. Such U.S. patent is assigned to the same assignee as that of the present invention, and its disclosure is hereby incorporated by reference herein.

In accordance with the present invention, any of the various types of night lights or other illumination devices described above are provided with a feature for automatically deactivating or deenergizing the night light bulb when the temperature of the immediately surrounding environment exceeds a predetermined temperature level. The present invention provides such a feature in a construction that is relatively inexpensive to manufacture and produce and that does not detract from the appearance of the night light device. The present invention further provides such a heat deactivating feature in a construction that allows the heat sensitive component or components of the night light device to be positioned for optimum, expedient detection of the immediately surrounding ambient temperature level.

In order to achieve the objectives mentioned above, an illumination device according to the present invention generally includes a housing, electrical plug prongs, a connector portion associated with the housing for receiving and electrically contacting a light bulb, and a heat sensitive electrical circuit for conducting electrical current from an electrical outlet or other electrical power source to a light bulb received within through the connector portion of the illumination device. Preferably, the heat sensitive electrical circuit includes a bimetallic strip or other heat sensitive mechanism that automatically interrupts the flow of electrical current through the connector portion of the night light when the temperature sensed by the bimetallic strip exceeds a predetermined temperature level. In this embodiment, the bimetallic strip simultaneously can also function as a current conductor, a heat sensor, and an electrical switch, and can also be located out of view in the housing of the illumination device.

In another embodiment of the present invention, an illumination device is equipped with a successive heat sensitive switching mechanism, in which the power conducted to the light bulb is initially reduced in response to ambient temperature levels exceeding a first predetermined temperature level, with the flow of electrical current to the light bulb being interrupted only in response to a second, higher predetermined temperature level.

Additional objects, advantages and features of the present invention will become apparent from the following description and appended claims, taken in conjunction with the accompanying drawings.

BRIEF DESCRIPTION OF THE DRAWINGS

FIG. 1 is a perspective view of an exemplary heat sensitive night light device according to the present invention.

FIG. 2 is a top plan view of the night light device of FIG. 1.

FIG. 3 is a cross-sectional view taken generally along line 3—3 of FIG. 1.

FIG. 4 is an elevational view of the night light of FIG. 1 shown with the rear half of the night light housing removed and with portions of the switch housing broken away.

FIG. 4A is a partial elevational view similar to that of FIG. 4, but illustrating an alternate construction of the night light of FIG. 4.

FIG. 5 is a cross-sectional view taken generally along line 5—5 of FIG. 3.

DETAILED DESCRIPTION OF THE PREFERRED EMBODIMENTS

Figure 6:
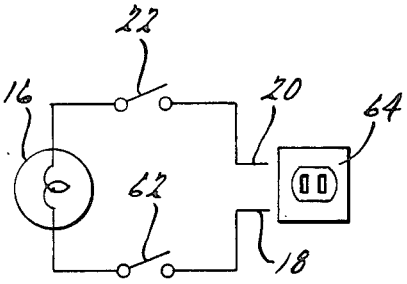
FIG. 6 is a circuit diagram of the heat sensitive night light of FIG. 1.

FIGS. 1 through 10 depict various exemplary embodiments of the present invention as employed in a night light. One skilled in the art will readily recognize from the following discussion that the principles of the present invention are equally applicable to illumination devices other than night lights, as well as to night light devices other than the exemplary night light embodiments depicted in the drawings for purposes of illustration only.

FIG. 1 illustrates an exemplary night light 10 according to the present invention, with the night light 10 generally including a housing 12 having a connector portion 14 for receiving a light bulb 16 electrically connected therein. Preferably a pair of electrical prongs 18 and 20 protrude from the housing 12 and are adapted to be inserted into, and electrically interconnected with, an electrical outlet receptacle.

Although not specifically required in the present invention, the exemplary night light 10 can include an optional manual switch 22 for selectively energizing or deenergizing the light bulb 16 when the night light 10 is plugged into an electrical outlet. Also optionally provided is a transparent or translucent enclosure 24 illustrated in phantom lines in FIG. 1.

As perhaps best illustrated in FIGS. 2 through 4, the housing 12 preferably includes a threaded opening 28 to allow the light bulb 16 to be threadably inserted therein. As shown in FIG. 2, a base connector or conductor 30 and a side connector or conductor 32 extend into the threaded opening 28 in order to electrically contact base and side electrodes on common light bulbs.

The housing 12 preferably includes a front half portion 36 and a rear half portion 38 removably connected to one another by way of a fastener 40 extending through a bore 42 in the front half portion 36 and a bore 44 in the rear half portion 38, as shown in FIG. 3. The manual switch 22 can be of the commonly-known push button variety, which includes a movable metallic eyelet 48 resiliently biased in an outward direction by a spring 50, which electrically interconnects the eyelet 48 with an inner end 52 of the base connector or conductor 30. The eyelet 48 is movably actuated by a push button 54 for selectively moving the eyelet 48 into and out of electrical contact with a tab 56 secured to, or integrally formed on, the prong 20, as shown in FIGS. 3 through 5.

The prong 20 in the night light 10 can be secured in place within the housing 12 in any of a number of ways, including the interconnection between a protuberance 58 extending from the body 60 of the switch 22. When the eyelet 48 of the switch 22 is moved into the position shown in FIGS. 3 and 5, it electrically contacts the tab 56 on the prong 20 in order to electrically interconnect the prong 20 with the base connector 30, thereby providing electrical communication between the prong 20 and the base electrode of the light bulb 16.

Figure 7:
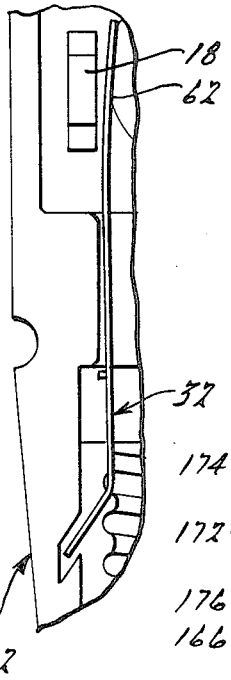
FIG. 7 is a detailed view illustrating the operation of a heat sensitive switching apparatus of the night light of FIG. 1.

As shown in FIGS. 4 and 5, the side connector 32 includes an inner end 62 that extends inwardly into the housing 12 to electrically contact the prong 18, thereby providing electrical communication between the prong 18 and the side electrode of the light bulb 16. In accordance with the present invention, the inner end 62 of the side connector 32 is a bimetallic strip, which can be integrally formed with the side connector or conductor 32 or secured thereto. As the immediate ambient temperature surrounding the night light 10, and especially the light bulb 16, rises to a predetermined temperature level, the thermal energy is conducted primarily by direct conduction along a relatively short path through the side connector or conductor 32 to its bimetallic strip 62 in order to cause the bimetallic strip 62 to move inwardly out of electrical contact with the prong 18, as shown in FIG. 7. Thus, the bimetallic strip 62 and the prong 18 function as a heat sensitive switch that interrupts the flow of electrical current from an electrical outlet 64 to the light bulb 16, as illustrated in the electrical schematic diagram of the night light 10 depicted in FIG. 6.

It should be emphasized that although the manual switch 22 is included in the embodiment of the present invention illustrated in FIGS. 1 through 6, such manual switch can optionally be eliminated such that the light bulb is energizable only when the night light is plugged into an electrical outlet. In other embodiments, many other types of switches can be employed in conjunction with the present invention, such as sound actuated switches or timer switches, for example. In these various optional constructions, the other components and applications of the present invention remain substantially similar to those of the exemplary embodiment depicted in FIGS. 1 through 7 for purposes of illustration.

FIG. 4A illustrates an alternate construction that is a variation on that of FIGS. 1 through 7, in which elements that are corresponding or similar to elements of FIG. 4 are indicated by reference numerals that are the same as those in FIG. 4, but with the addition of the suffix "a".

In FIG. 4A, the bimetallic strip **62*a* is not necessarily electrically interconnected with either the prong 18*a* or the side connector or conductor 32*a*. The bimetallic strip 62*a* is, however, at least mechanically interconnected with a contact 37*a*, which is electrically interconnected with the side connector or conductor 32*a*, such as by way of a flexible wire or other conductor 35*a*. The strip 62*a* thus biases the contact 37*a* toward electrical contact with the prong 18*a* When the temperature exceeds the predetermined level, as discussed above, the bimetallic strip 62*a* urges the contact 37*a* away from the prong 18*a*, and biases the contact 37*a* into electrical contact with the prong 18*a* when the temperature is below such predetermined level. In such an alternate construction, the strip 62*a* can be fixed to, or otherwise interconnected with, the housing 12*a* at a portion of the strip 62*a* that is spaced away from the contact 37*a*, or the strip 62*a* can also be interconnected with the side connector or conductor 32*a* in order to allow heat to be conductively transferred to the strip 62*a*** from the light bulb socket.

Figure 8:
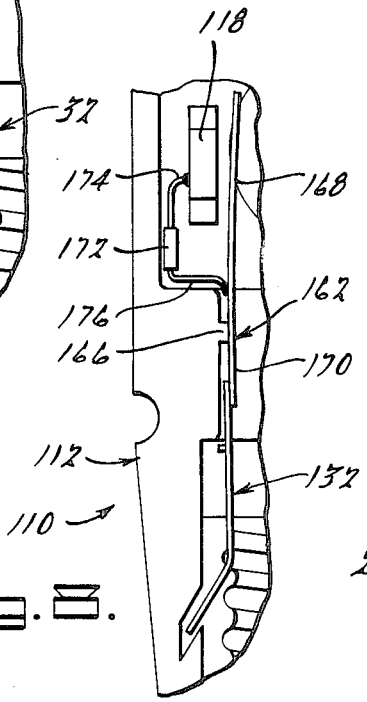
FIG. 8 is a detailed view similar to that of FIG. 7, but illustrating another embodiment of a night device according to the present invention.

FIG. 8 illustrates still another embodiment of the present invention as employed in an exemplary night light 110. It should be noted that the construction of the exemplary night light 110 is substantially similar to that of the night light 10 illustrated in FIGS. 1 through 7, except for the differences illustrated in FIG. 8. Accordingly, reference numerals for the components of the night light 110 shown in FIG. 8 are the same as those of either identical or corresponding components of the embodiment depicted in FIGS. 1 through 7, except that the reference numerals in FIG. 8 are one-hundred numerals higher.

In FIG. 8, the side connector or conductor 132 includes a separate, discrete bimetallic inner end 162 secured to the night light housing 112, such as by way of an electrically non-conductive post or tab 166. The bimetallic inner end or strip 162 is fixedly secured to the post 166 at an intermediate position between an inner portion 168 and an outer portion 170 of the bimetallic strip 162.

A diode 172 electrically interconnects the electrical prong 118 and the bimetallic strip 162 by way of electrical wires 174 and 176, with the wire 176 being electrically attached to the bimetallic strip 172 at a location generally adjacent the non-conductive post 166. Preferably, the distance between the post 166 and the area of engagement of the outer portion 170 with the side connector or conductor 132 is less than the distance between the post 166 and the area of engagement of the inner portion 168 with the electrical prong 118. Thus, as the ambient temperature exceeds a predetermined level, heat is conducted through the side connector 132 to the bimetallic strip 162, causing the inner portion 168 to deflect out of electrical contact with the electrical prong 118, as shown in FIG. 8, prior to the breaking of the contact between the bimetallic strip 162 and the side connector or conductor 132. This deflection interrupts the flow of electrical current from the electrical prong 118 to the side connector or conductor 132, thus causing the electrical current to instead flow from the electrical prong 118, through the diode 172 and the outer portion 170 of the bimetallic strip 162 to the side connector or conductor 132. In this condition, the power to the light bulb of the night light 110 is therefore reduced, which in turn tends to reduce the heat generation of the light bulb in order to lower the ambient temperature in the area immediately surrounding the night light 110.

If the ambient temperature immediately surrounding the night light 110 rises to exceed a second, higher predetermined temperature level, notwithstanding the reduction of power to the light bulb, the outer portion 170 of the bimetallic strip 162 then deflects inwardly out of engagement with the side connector or conductor 132 in order to totally interrupt the flow of electrical current to the light bulb. Thus, the arrangement in the embodiment of the present invention illustrated in FIG. 8 provides for successive heat sensitive switching, initially reducing the power conducted to the light bulb of the night light 110 in response to a first predetermined ambient temperature level, and then deenergizing the light bulb if the ambient temperature exceeds a second, higher predetermined temperature level.

It should be emphasized that the successive heat sensitive switching arrangement illustrated in FIG. 8 can be employed in night lights or other illumination devices irrespective of whether such illumination devices are also equipped with manually actuable switches or other switches.

Figure 9:
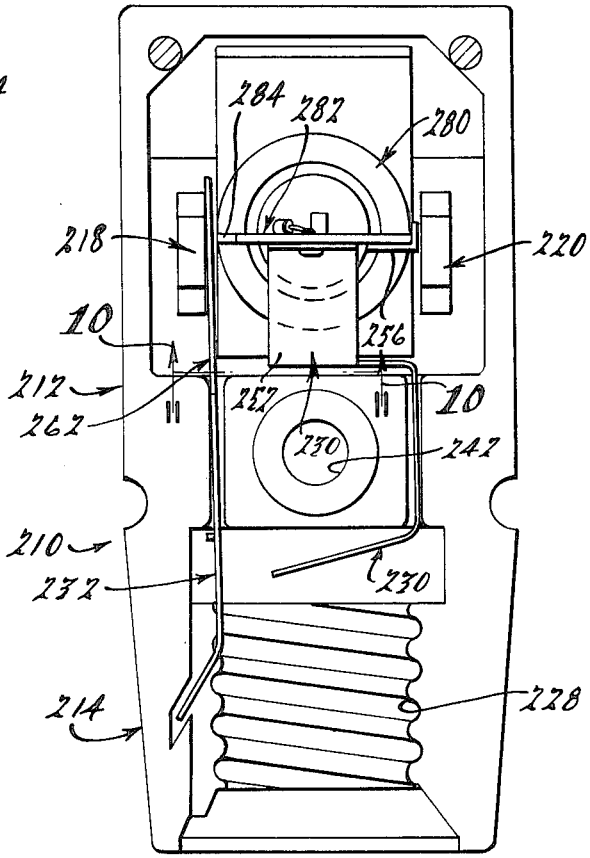
FIG. 9 is a cross-sectional view similar to that of FIG. 4, but illustrating still another embodiment of a night light according to the present invention.
Figure 10:
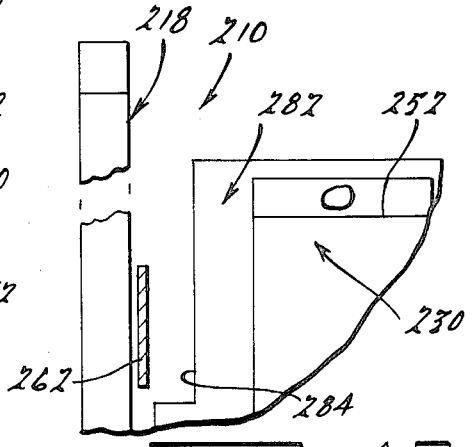
FIG. 10 is a partial cross-sectional view taken generally along line 10—10 of FIG. 9.

FIGS. 9 and 10 illustrate another application of the present invention in a night light 210, which is equipped with a photoelectric switch 280 adapted to electrically interconnect and energize the light bulb in response to predetermined low ambient light conditions and to electrically disconnect and deenergize the light bulb in response to predetermined higher ambient light conditions. Because many of the components are identical with, or correspond to, components of the night light 10 illustrated in FIGS. 1 through 7, such identical or corresponding components are identified by similar reference numerals in FIGS. 9 and 10 that are two-hundred numerals higher than the corresponding reference numerals of FIGS. 1 through 7.

The night light 210 preferably includes a circuit board 282, which can include electric or electronic components well-known to those skilled in the art, for purposes of causing the above-discussed light-responsive energization and deenergization of the light bulb of the night light 210. As shown in FIGS. 9 and 10, the circuit board 282 preferably includes a stepped or recessed portion 284 in order to provide clearance for movement of the bimetallic strip or inner end 262 of the side connector 232 when the bimetallic strip 262 deflects away from, and out of electrical contact with, the electrical prong 218, in the same manner as described above in connection with FIGS. 1 through 7. Thus, the night light 210 with its photoelectric switch 280 is equipped with the same heat sensitive switching apparatus as described above in connection with the night light 10. It should further be noted that the general arrangement depicted in FIG. 8, in connection with the exemplary night light 110, can also be alternately substituted for the arrangement shown in FIGS. 9 and 10 and can thus be employed in connection with a photoelectrically actuable and deactuable night light, or alternately in connection with night lights that have no other switching mechanism at all.

It should be further be noted in connection with all of the various embodiments of the present invention depicted in the drawings and discussed above, that the bimetallic strip in each of these embodiments can also alternately be arranged and positioned to engage the opposite sides of the electrical prongs and side connectors from those shown in the drawings. Thus, because of such flexibility, along with the physical arrangements shown for purposes of illustration in the drawings, the heat sensitive features of the present invention can be employed in night lights or other illuminations devices substantially without detracting from the appearance of such devices or adding to their overall physical dimensions. Furthermore, because of the short, straightforward and direct physical path between the side connectors or conductors and the bimetallic strips discussed above, the ambient temperature level immediately surrounding the light bulbs of the illumination devices can be very rapidly and directly sensed, and the heat sensitive switching mechanism of the present invention can accordingly respond very quickly to elevated temperatures.

The foregoing discussion discloses and describes exemplary embodiments of the present invention. One skilled in the art will readily recognize from such discussion, and from the accompanying drawings and claims, that various changes, modifications, and variations may be made therein without departing from the spirit and scope of the invention as defined in the following claims.

What is claimed is:

1. An electrical device for providing illumination, comprising:

a housing;

a connector means associated with said housing for receiving a light bulb and for electrically interconnecting said light bulb with a source of electric current;

heat sensitive circuit means associated with said housing for electrical communication between said electric current source and providing and interrupting said light bulb through said connector means, said circuit means including bimetallic means for automatically interrupting the flow of electric current through said connector means when the temperature sensed by said bimetallic means reaches a predetermined temperature level;

said bimetallic means including an electrical conductor through which the current flow in said circuit means must pass, said electrical conductor having at least a portion thereof composed of a bimetallic composition; said bimetallic portion of said electrical conductor being deflectable away from a portion of said connector means in response to said temperature reaching said predetermined temperature level and being biased and movable into electrical contact with said portion of said connector means in response to temperature levels below said predetermined temperature level; and reduced power connecting means for electrically interconnecting said light bulb with said electric current source at a reduced power level which does not totally interrupt electrical current flow to said light bulb when said bimetallic portion is deflected away from said portion of said connector means.

2. An electrical device according to claim 1, wherein said bimetallic conductor carries all of the current flow passing through said connector means.

3. An electrical device according to claim 1, wherein said connector means includes an opening formed in said housing, said electrical conductor extending at least in part in said opening in order to electrically contact said light bulb when said light bulb is inserted therein.

4. An electrical device according to claim 1, wherein said portion of said connector means comprises an electrical prong adapted to be inserted into an electrical outlet.

5. An electrical device according to claim 1, wherein said bimetallic portion of said electrical conductor is separate from a second portion of said electrical conductor and is deflectable out of electrical contact with said second portion of said electrical conductor in response to said temperature reaching a second predetermined temperature level higher than said first predetermined temperature level, said bimetallic portion being biased and movable into electrical contact with said second portion of said electrical conductor in response to temperature levels below said second predetermined temperature level.

6. An electrical device according to claim 5, wherein said connector means includes an opening formed in said housing, second portion of said electrical conductor extending at least in part into said opening in order to electrically contact said light bulb when said light bulb is inserted therein.

7. An electrical device according to claim 1, wherein said reduced power connecting means includes a diode electrically interconnected with said bimetallic portion and said portion of said connector means.

8. An electrical device according to claim 7, wherein said portion of said connector means comprises an electrical prong adapted to be inserted into an electrical outlet.

9. An electrical device according to claim 1, wherein said connector means further includes switch means for selectively energizing and deenergizing said light bulb.

10. An electrical device according to claim 9, wherein said switch means comprises a manually operable switch.

11. An electrical device according to claim 9, wherein said switch means comprises a photoelectric switch means for energizing said light bulb in response to a predetermined low ambient light level and for deenergizing said light bulb in response to an ambient light level higher than said predetermined low ambient light level.

12. An electrical device according to claim 1, wherein said connector means includes a movable electrical conductor through which the current flow in said circuit means must pass; said bimetallic means including a bimetallic strip; said electrical conductor having at least a portion thereof interconnected with said bimetallic strip, said bimetallic strip being deflectable to urge said electrical conductor away from a portion of said connector means in response to said temperature reaching said predetermined temperature level and being biased and movable to urge said electrical conductor into electrical contact with said portion of said connector means in response to temperature levels below said predetermined temperature level.

13. An electrical device according to claim 12, wherein said electrical conductor carries all of the current flow passing through said connector means.

14. An electrical night light device, comprising:

a housing;

connector means associated with said housing for receiving a light bulb and for electrically interconnecting said light bulb with a source of electric current, said connector means including an opening formed in said housing for receiving said light bulb inserted therein, an electrical conductor within said housing extending at least in part into said opening in order to electrically contact said light bulb when said light bulb is inserted therein, and an electrical prong protruding from said housing and adapted to be inserted into an electrical outlet; and heat sensitive bimetallic means associated with said electrical conductor and electrically interconnected therewith, said bimetallic means being biased into electrical contact with a portion of said electrical prong and deflectable out of said electrical contact with said portion of said electrical prong in response to said bimetallic means sensing a temperature reaching a predetermined temperature level, said bimetallic means being biased into said electrical contact with said portion of said electrical prong in response to said bimetallic means sensing a temperature below said predetermined temperature level.

15. An electrical night light device according to claim 14, wherein said portion of said electrical prong, said bimetallic means and said electrical conductor are all contained within said housing.

16. An electrical night light device according to claim 14, further comprising connector means further includes switch means for selectively energizing and deenergizing said light bulb.

17. An electrical night light device according to claim 16, wherein said switch means comprises a manually operable switch.

18. An electrical night light device according to claim 16, wherein said switch means comprises a photoelectric switch means for energizing said light bulb in response to a predetermined low ambient light level and for deenergizing said light bulb in response to an ambient light level higher than said predetermined low ambient light level.

19. An electrical night light device, comprising:

a housing;

connector means associated with said housing for receiving a light bulb and for electrically interconnecting said light bulb with a source of electric current, said connector means including an opening formed in said housing for receiving said light bulb inserted therein, an electrical conductor within said housing extending at least in part into said opening in order to electrically contact said light bulb when said light bulb is inserted therein, and an electrical prong protruding from said housing and adapted to be inserted into an electrical outlet; and heat sensitive bimetallic means associated with said electrical conductor and electrically interconnected therewith, said bimetallic means biasing said electrical conductor into electrical contact with a portion of said electrical prong and being deflectably movable to urge said electrical conductor out of said electrical contact with said portion of said electrical prong in response to said bimetallic means sensing a temperature reaching a predetermined temperature level, said bimetallic means biasing said electrical conductor into said electrical contact with said portion of said electrical prong in response to said bimetallic means sensing a temperature below said predetermined temperature level.

20. An electrical night light device according to claim 19, wherein said portion of said electrical prong, said bimetallic means and said electrical conductor are all contained within said housing.

21. An electrical night light device according to claim 19, further comprising connector means further includes switch means for selectively energizing and deenergizing said light bulb.

22. An electrical night light device according to claim 21, wherein said switch means comprises a manually operable switch.

23. An electrical night light device according to claim 21, wherein said switch means comprises a photoelectric switch means for energizing said light bulb in response to a predetermined low ambient light level and for deenergizing said light bulb in response to an ambient light level higher than said predetermined low ambient light level.

24. An electrical night light device, comprising:

a housing;

connector means associated with said housing for receiving a light bulb and for electrically interconnecting said light bulb with a source of electric power, said connector means including an opening formed in said housing for receiving said light bulb inserted therein, an electrical conductor within said housing extending at least in part into said opening in order to electrically contact said light bulb when said light bulb is inserted therein, and an electrical prong protruding from said housing and adapted to be inserted into an electrical outlet;

heat sensitive bimetallic means having a first portion biased into electrical contact with a portion of said electrical prong and deflectable out of said electrical contact with said portion of said electrical prong in response to said bimetallic means sensing a temperature reaching a first predetermined temperature level, said first portion of said bimetallic means being biased into said electrical contact with said portion of said electrical prong in response to said bimetallic means sensing a temperature below said first predetermined temperature level, said bimetallic means having a second portion biased into electrical contact with a portion of said electrical conductor and deflectable out of said electrical contact with said portion of said electrical conductor in response to said bimetallic means sensing a temperature reaching a second predetermined temperature level higher than said first predetermined temperature level in order to thereby electrically disconnect said light bulb from said power source, said second portion of said bimetallic means being biased into electrical contact with said portion of said electrical conductor in response to said bimetallic means sensing a temperature below said second predetermined temperature level; and power reduction means electrically interconnected with said electrical prong and said first portion of said bimetallic means for providing electrical communication therebetween at a reduced power level in order to reduce the power level provided to said light bulb when said first portion of said bimetallic strip is deflected away from said portion of said electrical prong in response to said temperature reaching said first predetermined temperature level.

25. An electrical night light device according to claim 24, wherein said portion of said electrical prong, said bimetallic means and said electrical conductor are all contained within said housing.

26. An electrical night light device according to claim 24, further comprising connector means further includes switch means for selectively energizing and deenergizing said light bulb.

27. An electrical night light device according to claim 26, wherein said switch means comprises a manually operable switch.

28. An electrical night light device according to claim 26, wherein said switch means comprises a photoelectric switch means for energizing said light bulb in response to a predetermined low ambient light level and for deenergizing said light bulb in response to an ambient light level higher than said predetermined low ambient light level.

29. An electrical night light device according to claim 24, wherein said power reduction means comprises a diode.

30. An electrical night light device according to claim 24, wherein said bimetallic means is fixedly secured to said housing at an intermediate location between said first and second portions of said bimetallic means.

31. An electrical night light device according to claim 30, wherein said bimetallic means comprises a bimetallic strip, the distance between intermediate location on said bimetallic strip and said contact of said first portion of said bimetallic strip with said electrical prong, is greater than the distance between said intermediate location on said bimetallic strip and said contact of said second portion of said bimetallic strip with said electrical conductor.

* * * * *